US005713337A

United States Patent [19]

Scheffel

[11] Patent Number: 5,713,337

[45] Date of Patent: Feb. 3, 1998

[54] APPARATUS FOR INTERMITTENTLY ATOMIZING AND INJECTING FUEL

[76] Inventor: Bernd W. Scheffel, Ernst-Haeckel-Str. 71A, 80999 Munchen, Germany

[21] Appl. No.: 716,095

[22] Filed: Sep. 19, 1996

[30] Foreign Application Priority Data

Sep. 22, 1995 [EP] European Pat. Off. ..... 95114976

[51] Int. Cl.[6] ..... F02M 23/00

[52] U.S. Cl. ..... 123/533

[58] Field of Search ..... 123/533, 531, 123/73 C, 26, 585, 587, 532, 534

[56] References Cited

U.S. PATENT DOCUMENTS

| | | | |
|---|---|---|---|
| 5,131,375 | 7/1992 | Sakamoto | 123/533 |
| 5,146,904 | 9/1992 | Olson et al. | 123/533 |
| 5,150,692 | 9/1992 | Trombley et al. | 123/533 |
| 5,156,133 | 10/1992 | Sugimoto et al. | 123/533 |
| 5,239,970 | 8/1993 | Kurihara | 123/533 |

*Primary Examiner*—Raymond A. Nelli
*Attorney, Agent, or Firm*—Robert W. Becker & Associates

[57] ABSTRACT

An apparatus for intermittently atomizing and injecting fuel with the assistance of air. The apparatus includes a cylinder (1) having a cylinder head (4) with a valve seat (5) and at a flow passage, a piston (2) driven within the cylinder by a rotating crankshaft (3), an injection valve (6) with a valve head (14) and a spring element (7) urging the valve head (14) into engagement with the valve seat (5) to close the flow passage. The injection valve generally includes an actuating surface (12) that cooperates with the piston (2) to mechanically open the valve (6) when the piston reaches the end of its compression stroke. As a result, the present invention delays the start of valve opening until the piston maximizes the atomizing pressure within the cylinder (1) thereby advantageously maintaining small fluid drop sizes and high velocity of the spray jet. Additionally an annular gap (16) around the valve head (14) directs the spray jet centrally into the combustion chamber (10).

3 Claims, 3 Drawing Sheets

APPARATUS FOR INTERMITTENTLY ATOMIZING AND INJECTING FUEL

BACKGROUND OF THE INVENTION

The present invention relates to an apparatus for intermittently atomizing and injecting fuel with the assistance of air. It has a cylinder piston arrangement and a crankshaft for driving the piston. The cylinder head has at least one aperture for the mixture of fuel and air to be blown through. In this aperture, a mushroom type injection valve has a valve seat for the valve head. A spring keeps the valve head on the valve seat during a closed position. This apparatus is for injecting fuel into a combustion chamber after this has been chavenged and filled with the air necessary for combustion.

When fuel is atomized with the assistance of air, an increase of drop size can be found at lower pressures. Since the preferred application of the invention is for fuel injection in combustion engines, the size of drops and the distribution of the drops are critical for the completeness of the combustion and for the quality of exhaust gases. The drops should be as small as possible and the protrusion of the cloud of drops should be sufficient for the whole combustion chamber.

Existing devices having a cylinder piston arrangement as a pressure source for each injection valve could produce a pressure up to 0.7 MPa at upper dead center if the injection valve would be kept closed. The apparatus according to European patent application EP 0 514 982 A1 reaches much lower pressure during atomization. The opening of the valve is driven by the pressure of the mixture. To obtain a sufficient lift of the valve at higher RPM the valve has to open already at low pressure. This however leads to low velocity of the spray jet, resulting in atomization of bad quality and insufficient protrusions of the spray cloud into the combustion chamber. Furthermore this device produces a drop distribution of cone shape which leads to wall contact of the drops and which leaves the center of the combustion chamber nearly empty of fuel mixture. The result is imperfect combustion, causing high fuel consumption and impaired exhaust emissions.

It is an object of the present invention to improve an apparatus of the aforementioned general type in such a way that the atomizing pressure is higher, the protrusion of the spray jet is better and without wall contact.

In order to produce late, fast and sufficient lift of the valve, the valve is opened by mechanical positive control, the valve lift is caused directly by the piston. The piston hits the valve at the end of the compression stroke, opens it and leaves it at the return stroke, allowing the spring to close it. When the valve is closed, an actuating surface at the valve stem is reaching into the trajectory of the piston. Shortly before reaching upper dead center an actuating surface of the piston touches the actuating surface on the valve stem and moves it to upper dead center. This way, time and size of the lift can be defined precisely. The force of the spring is made high enough so that the valve will not be opened by the rising pressure. This method of opening the injection valve therefore allows high air pressure and sufficient lift of the injection valve.

Claims 2 and 3 contain further advantageous details of the invention. The valve has an actuating member which provides sufficient actuating surface for the piston and as well as a set for the spring element. The actuating member is joined at the valve stem after insertion in the bore of the valve seat.

Since the spray jet achieves wide protrusion into the combustion chamber, extra provision is made to guaranty sufficient mixture at the spark plug. One or more axial grooves in the cylindrical protrusion of the valve seat allow part of the flow of the fuel-air mixture to expand sideways of the main spray jet towards the spark plug.

BRIEF DESCRIPTION OF THE DRAWINGS

This object, and other objects of the present invention, will appear more clearly in the following specification in conjunction with the accompanying schematic drawings, in which.

SUMMARY OF THE INVENTION

The present invention is characterized by two features improving the injection. The first is high atomizing pressure for small drop size and high velocity of the spray jet. This is achieved by having the piston control the injection valve opening. The second is directing this effective spray jet centrally into the combustion chamber and avoiding wall contact of the drops. To achieve this, a protrusion of the valve seat is directing the spray jet substantially parallel to the axis of the injection valve.

DESCRIPTION OF PREFERRED EMBODIMENTS

Figure 1:
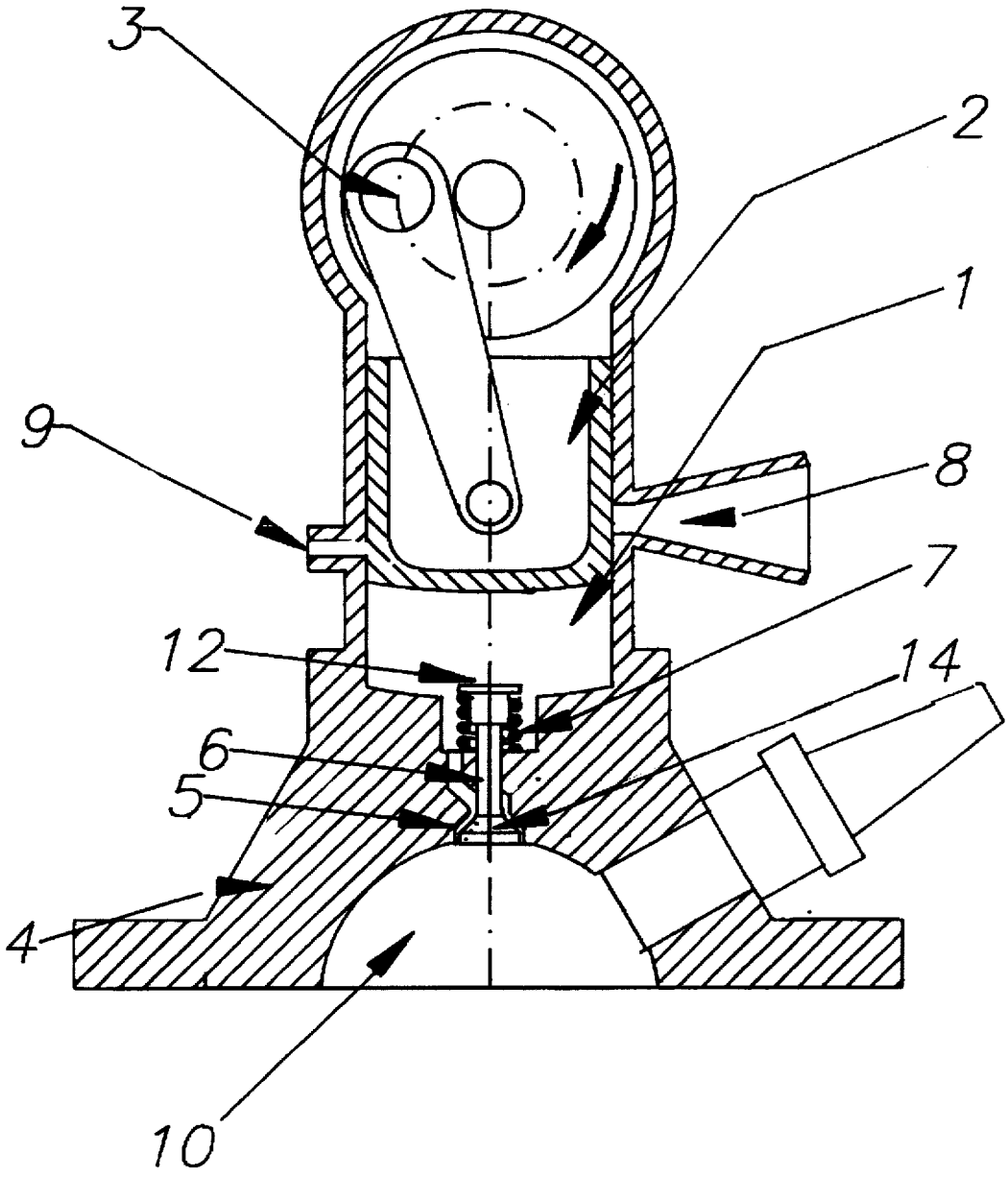
FIG. 1 is a cross-sectional view through one exemplary embodiment of the inventive apparatus for intermittently atomizing and injecting fuel with the assistance of air.

Referring now to the drawings in detail, the main elements of the apparatus for intermittently atomizing and injecting fuel with the assistance of air are shown in FIG. 1, as there are the cylinder 1, the piston 2 and the crankshaft 3, the cylinderhead 4 containing the valve seat 5, the valve 6 and the spring 7. Possible embodiments for the air inlet 8 and the fluid inlet 9 are shown on cylinder 1. Piston 2, which is driven by the rotating crankshaft 3 is intermittently compressing the mixture of fuel and air formed through the inlets. In the position of maximal compression the injection valve 6 is opened by the piston 2 and the mixture is atomized and projected to the combustion chamber 10. Preceding the next compression the cylinder 1 will be filled again and the cycle will be repeated.

Figure 2:
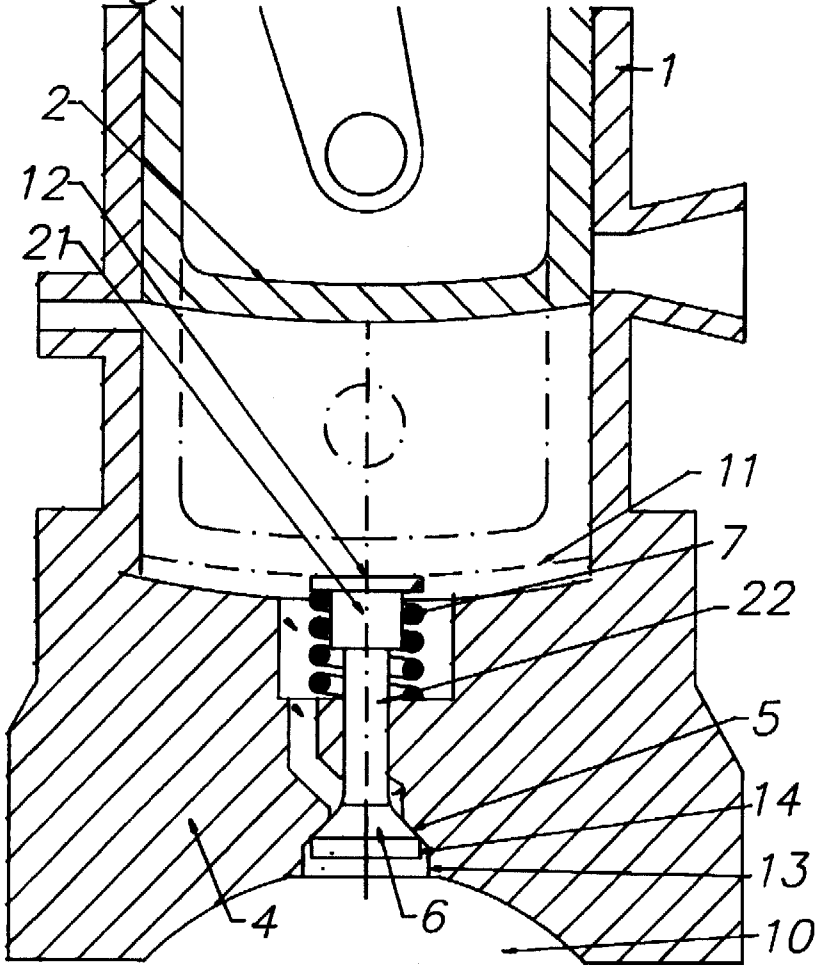
FIG. 2 is a cross-sectional view through the cylinder head with an aperture and an injection valve in a closed position.

In FIG. 2 can be seen: the cylinder 1 and the piston 2 on its travel to its dead center 11 of highest compression, the cylinder head 4, the valve seat 5, the injection valve 6 and the spring 7. An actuating member 21 is joint at the valve stem 22 and it contains the actuating surface 12. The piston 2 is not yet at its dead center 11 and has not yet touched the actuating surface 12 of the injection valve 6. The injection valve 6 is being held at its valve seat 6 by the force of the spring 7. While the injection valve 6 is being closed the pressure rises in the cylinder 1. Downstream of the valve seat 5 as a cylindrical protrusion 13 is formed in the cylinder head. This protrusion 13 has a slightly larger diameter than the valve head 14.

Figure 3:
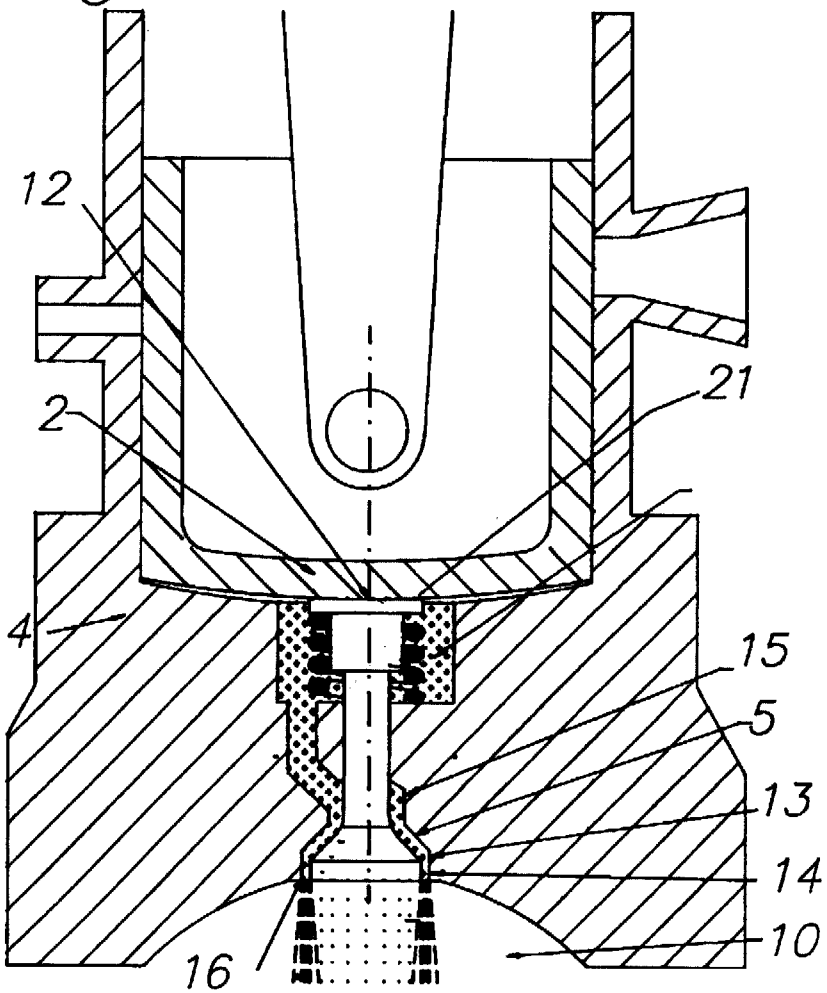
FIG. 3 is a cross-sectional view through the cylinder head with an aperture and an injection valve in an open position.

In FIG. 3 the piston has arrived at its dead center 11. Shortly before that, it has touched the actuation surface 12 on the injection valve 6 and from there the valve has participated in the pistons stroke. The injection valve 6 has been lifted off the valve seat 5. The flow of fuel-air mixture 15 is passing the valve seat 5 reaching the annular gap 16 formed by the valve head 14 and the protrusion 13. When it leaves the annular gap 16 the flow of the fuel-gas mixture is substantially parallel the the axis of the valve and it is entering the combustion chamber 10.

Figure 4:
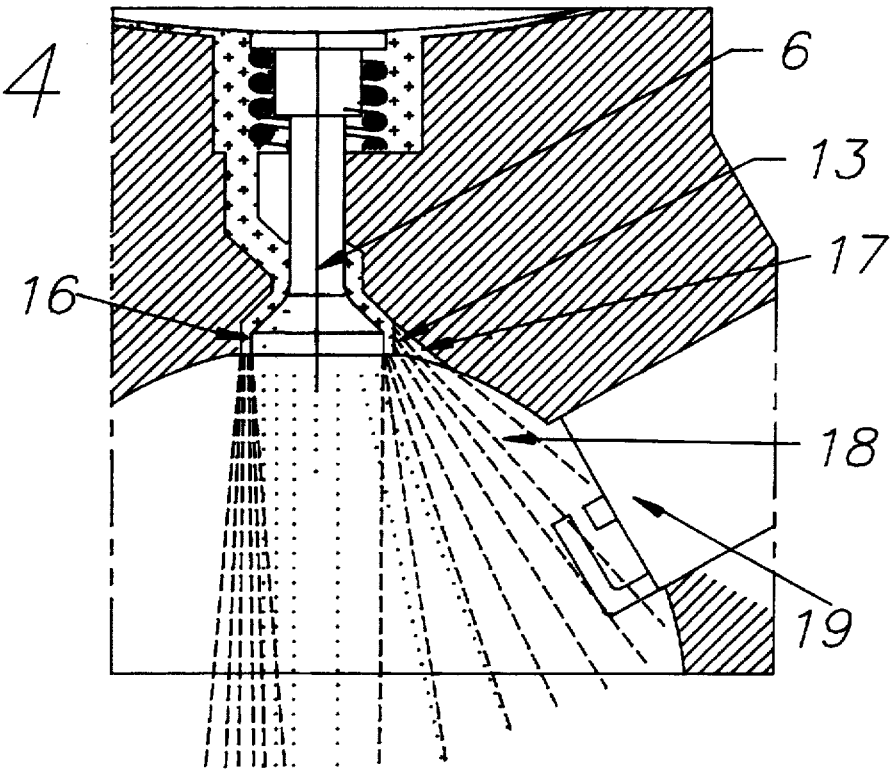
FIG. 4 is a cross-sectional view through the cylinder head with a spark plug and an injection valve in an open position.

In FIG. 4 the valve 6 is shown in the open position at its maximal lift. The annular gap 16 connects to a radial groove 17 formed in the cylinder head 4. Therefore a side spray 18 can enter the combustion chamber 10. This side spray 18 is positioned so that it reaches the region of the spark plug 19. This way it is ensured, that the mixture at the spark plug is rich enough for ignition.

Figure 5:
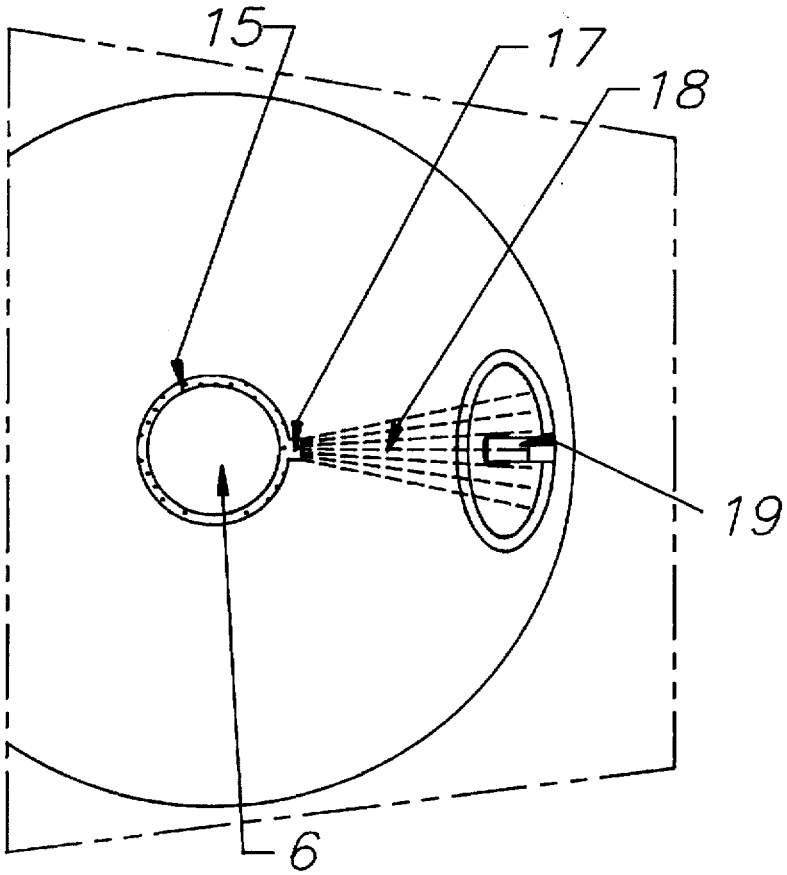
FIG. 5 is a view from the combustion chamber towards the injection valve and spark plug.

In FIG. 5 looking upstream, it can be seen how the side spray 18 releases from the annular gap 16 into the radial groove 17. The annular gap 16 could be modified in several ways. For example it could also be of varying width around its circumference.

A preferred application of the invention is for fuel injection in combustion engines. In this case the drive of the piston 2 is syncronised with the combustion engine. The present invention is, of course, in no way restricted to the specific disclosure of the specification and drawings, but also encompasses any modifications within the scope of the appended claims.

I claim:

1. An apparatus for intermittently atomizing and injecting fuel with the assistance of air having a cylinder-piston arrangement with a rotating crankshaft to drive the piston, a cylinder head with a valve seat and at least one aperture defining a flow passage, an injection valve with a valve head and valve stem and a spring element biasing the valve head onto the valve seat characterised in that an actuating surface (12) is formed on the stem side end of the injection valve (6), said actuating surface (12) protruding into the travel path of the piston (2) a predetermined distance when said injection valve (6) is in a closed position and said valve seat (5) having a substantially cylindrical protrusion (13) at its downstream side and said protrusion (13) and the valve head (14) are forming an annular gap (16) for directing the fuel-air mixture in a direction substantially parallel to the axis of the injection valve (6).

2. An apparatus as claimed in claim 1, characterised in that said injection valve (6) at its stem side end includes an actuating member (21) which contains said actuating surface (12) and which cooperates with said spring element (7).

3. An apparatus as claimed in claim 1, characterised in that said cylindrical protrusion (13) of the valve seat (5) has one or more radial grooves (17).

* * * * *